US006823883B1

(12) United States Patent
Sears

(10) Patent No.: US 6,823,883 B1
(45) Date of Patent: Nov. 30, 2004

(54) COLLAPSIBLE, SELF-SUPPORTING, PORTABLE SUN-SCREEN APPARATUS

(76) Inventor: Keith Sears, 1830 Bell St., #16, Sacramento, CA (US) 95827

( * ) Notice: Subject to any disclaimer, the term of this patent is extended or adjusted under 35 U.S.C. 154(b) by 35 days.

(21) Appl. No.: 10/280,245

(22) Filed: Oct. 24, 2002

(51) Int. Cl.[7] ..... E04H 15/00

(52) U.S. Cl. ..... 135/128; 135/115; 135/116; 248/99

(58) Field of Search ..... 135/116, 115, 135/117, 148, 143, 901, 149, 119, 128; 248/99; 108/90; 211/123, 119.009, 189, 195, 16

(56) References Cited

U.S. PATENT DOCUMENTS

| | | | | | |
|---|---|---|---|---|---|
| D142,304 | S | * | 8/1945 | Marchand | D6/410 |
| 2,511,452 | A | * | 6/1950 | Anderson | 135/157 |
| 2,728,165 | A | * | 12/1955 | Runyon | 108/90 |
| 2,811,977 | A | * | 11/1957 | McClish | 297/184.14 |
| 2,840,093 | A | * | 6/1958 | Roe | 135/91 |
| 2,864,388 | A | * | 12/1958 | Oliver | 135/133 |
| 3,132,658 | A | * | 5/1964 | Hickman | 135/139 |
| 3,226,737 | A | * | 1/1966 | Kyle | 5/417 |
| D216,438 | S | * | 1/1970 | Gay et al. | D34/6 |
| 3,509,891 | A | * | 5/1970 | Bolt | 135/148 |
| 3,638,888 | A | * | 2/1972 | Ross | 248/97 |
| 3,799,608 | A | * | 3/1974 | Smutny et al. | 297/184.14 |
| 3,862,876 | A | * | 1/1975 | Graves | 428/83 |
| 3,885,256 | A | * | 5/1975 | Du Boff | 5/504.1 |
| 3,960,193 | A | * | 6/1976 | Davis | 108/90 |
| 4,174,085 | A | * | 11/1979 | Ferreira et al. | 248/97 |
| 4,223,056 | A | * | 9/1980 | Di Fronzo | 428/52 |
| D258,035 | S | * | 1/1981 | Fenwick | D6/603 |
| 4,295,481 | A | | 10/1981 | Gee | |
| 4,634,618 | A | * | 1/1987 | Greer et al. | 428/81 |
| 4,639,036 | A | | 1/1987 | Nichols | |
| 4,643,479 | A | * | 2/1987 | Servi | 297/184.15 |
| 4,700,731 | A | | 10/1987 | Smith | |
| 4,709,430 | A | * | 12/1987 | Nicoll | 5/417 |
| 4,910,855 | A | * | 3/1990 | Balarzs | 29/426.4 |
| 4,981,274 | A | * | 1/1991 | McVay et al. | 248/99 |
| 5,000,210 | A | | 3/1991 | Worthington, Jr. | |
| 5,018,229 | A | * | 5/1991 | Eberhart | 5/417 |
| 5,088,514 | A | | 2/1992 | House et al. | |
| 5,096,257 | A | | 3/1992 | Clark | |
| 5,102,190 | A | | 4/1992 | Akin et al. | |
| 5,203,363 | A | | 4/1993 | Kidwell et al. | |
| 5,368,057 | A | * | 11/1994 | Lubkeman et al. | 135/133 |
| D361,439 | S | | 8/1995 | Patton | |
| 5,560,502 | A | * | 10/1996 | Hsiung | 211/195 |
| 5,638,849 | A | | 6/1997 | Scott | |
| D389,451 | S | * | 1/1998 | Wilson | D12/401 |
| D389,632 | S | * | 1/1998 | Reddin | D34/6 |
| 5,797,650 | A | | 8/1998 | Gonzalez, Jr. et al. | |
| 5,966,757 | A | * | 10/1999 | Sullivan | 5/417 |
| 5,967,601 | A | | 10/1999 | Gillins | |
| 6,050,280 | A | | 4/2000 | Jeske | |
| D428,544 | S | * | 7/2000 | Moffitt et al. | D34/5 |
| 6,095,172 | A | | 8/2000 | Trapp et al. | |
| 6,170,100 | B1 | * | 1/2001 | Le Gette et al. | 5/417 |
| 6,260,566 | B1 | * | 7/2001 | LaFave et al. | 135/88.01 |
| 6,279,986 | B1 | * | 8/2001 | Hinsperger | 296/102 |
| 6,508,183 | B2 | * | 1/2003 | Kerrigan | 108/90 |
| D470,332 | S | * | 2/2003 | Clucas et al. | D6/410 |
| D475,551 | S | * | 6/2003 | Kelso | D6/410 |

FOREIGN PATENT DOCUMENTS

| | | | | | |
|---|---|---|---|---|---|
| FR | 2528083 | A | * | 12/1983 | D06F/57/08 |
| FR | 2694174 | A1 | * | 2/1994 | A47F/5/01 |

* cited by examiner

*Primary Examiner*—Ramon O. Ramirez
*Assistant Examiner*—Ingrid Weinhold
(74) *Attorney, Agent, or Firm*—Thomas R. Lampe

(57) ABSTRACT

A collapsible, self-supporting portable sun-screen apparatus includes a canopy support and a flexible canopy positioned over a frame of the canopy support. The canopy and canopy support are not affixed so that the canopy can be slid relative to the frame and offset relative to the canopy support to adjust for sun movement. Weights are provided to provide stability to the canopy and keep it in the desired position.

11 Claims, 2 Drawing Sheets

COLLAPSIBLE, SELF-SUPPORTING, PORTABLE SUN-SCREEN APPARATUS

TECHNICAL FIELD

This invention relates to a sun-screen which can be readily collapsed and transported and also quickly assembled at a location where screening from sun is desired.

BACKGROUND OF THE INVENTION

Many portable sun-screen arrangements have been devised in the past. Such arrangements are often utilized as screens from the sun for the occupant of a chair, and such prior art arrangements often require a direct interconnection between the chair and the sun-screen structure in order to perform the desired screening function. Also, adjustment for changes in position of the sun in the sky usually requires movement of the entire structure on the part of the user.

The following United States patents are believed to be representative of the current state of the art in this field: U.S. Pat. No. 5,102,190, issued Apr. 7, 1969, U.S. Pat. No. 5,638,849, issued Jun. 17, 1997, U.S. Pat. No. 5,797,650, issued Aug. 25, 1998, U.S. Pat. No. 5,967,601, issued Oct. 19, 1999, U.S. Pat. No. 6,050,280, issued Apr. 18, 2000, U.S. Pat. No. 6,095,172, issued Aug. 1, 2000, U.S. Pat. No. 5,096,257, issued Mar. 17, 1992, U.S. Pat. No. 5,000,210, issued Mar. 19, 1991, U.S. Pat. No. 4,639,036, issued Jan. 27, 1987, U.S. Pat. No. 361,439, issued Aug. 22, 1995, U.S. Pat. No. 4,295,481, issued Oct. 20, 1981, U.S. Pat. No. 5,203,363, issued Apr. 20, 1993, Pat. No. 5,088,514, issued Feb. 18, 1992 and U.S. Pat. No. 4,700,731, issued Oct. 20, 1987. The known prior art, whether taken alone or in combination, does not teach or suggest the combination of unique structural features disclosed and claimed herein.

DISCLOSURE OF INVENTION

The present invention is characterized by its simplicity, ease of use and relatively low cost. The apparatus can be utilized with any type of chair to screen an individual from the sun, the apparatus being self-supporting and not requiring connection to a chair.

The invention relates to a collapsible, self-supporting, portable sun-screen apparatus which includes a flexible canopy having a central canopy segment having an outer periphery and side canopy segments depending from the outer periphery of the central canopy segment. The side canopy segments have side canopy segment lower edges.

The apparatus also includes a canopy support supporting the canopy. The canopy support includes a canopy support base for positioning on the ground or other surface, at least one vertically disposed elongated element connected to the canopy support base and extending upwardly therefrom and a canopy support frame connected to the at least one vertically disposed elongated element at a location spaced from the canopy support base. The frame extends over the canopy support base.

The central canopy segment is positioned on the frame with the side canopy segments disposed outside of the frame and alongside the frame. The canopy is not attached to the frame whereby the central canopy segment may be slid on the frame by exerting a manual force thereon to offset the canopy relative to the frame and change the distances between the side canopy segment lower edges and the ground or other support surface.

Other features, advantages and objects of the present invention will become apparent with reference to the following description and accompanying drawings.

MODES FOR CARRYING OUT THE INVENTION

Figures 1, 2, 3:
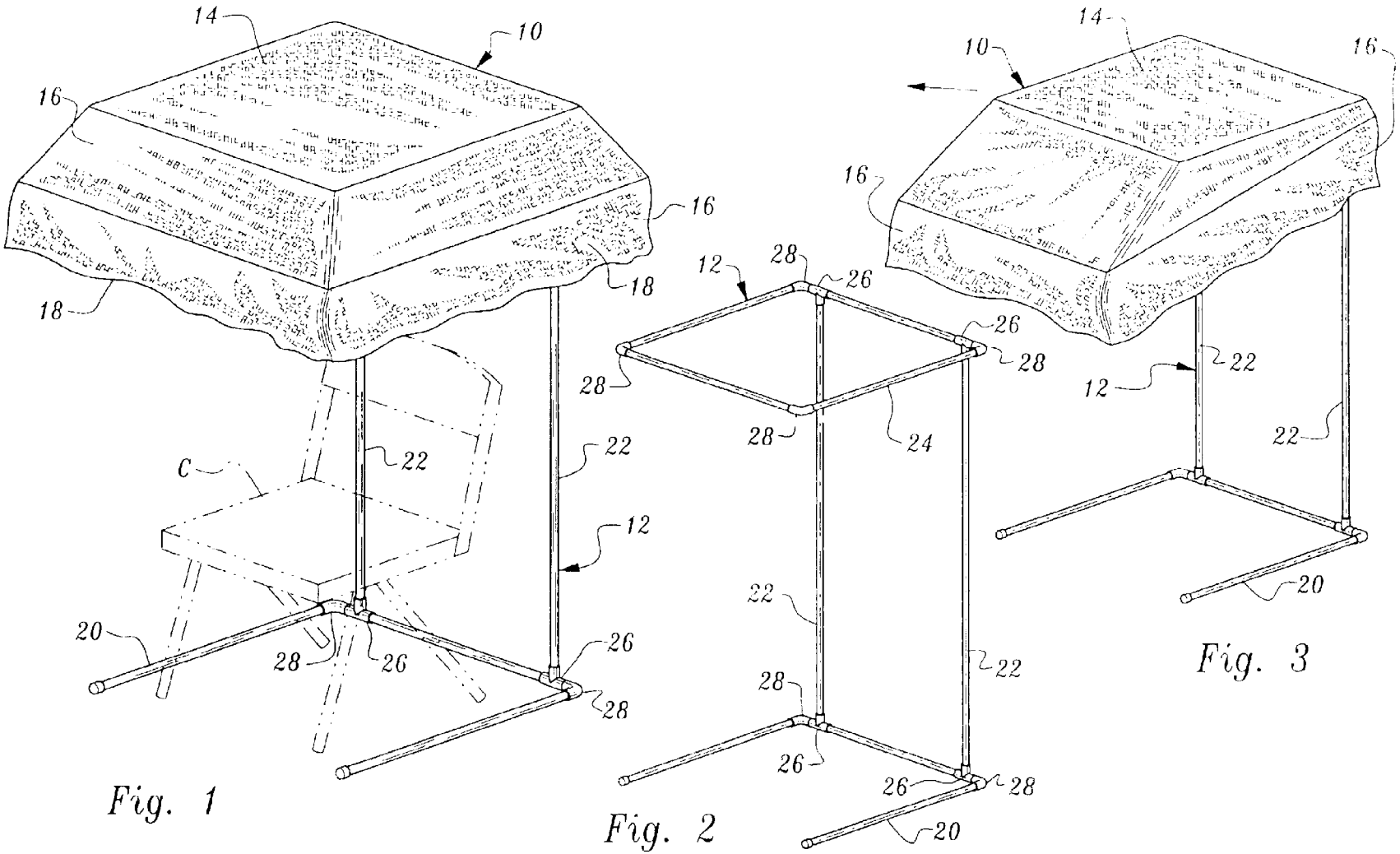
FIG. 1 is a perspective view illustrating apparatus constructed in accordance with the teachings of the present invention assembled and providing a screen for a chair, the latter being shown by phantom lines.
FIG. 2 is a perspective view illustrating the assembled canopy support of the apparatus.
FIG. 3 is a view similar to FIG. 1, but illustrating the canopy displaced relative to the canopy support from the position shown in FIG. 1.
Figure 4:
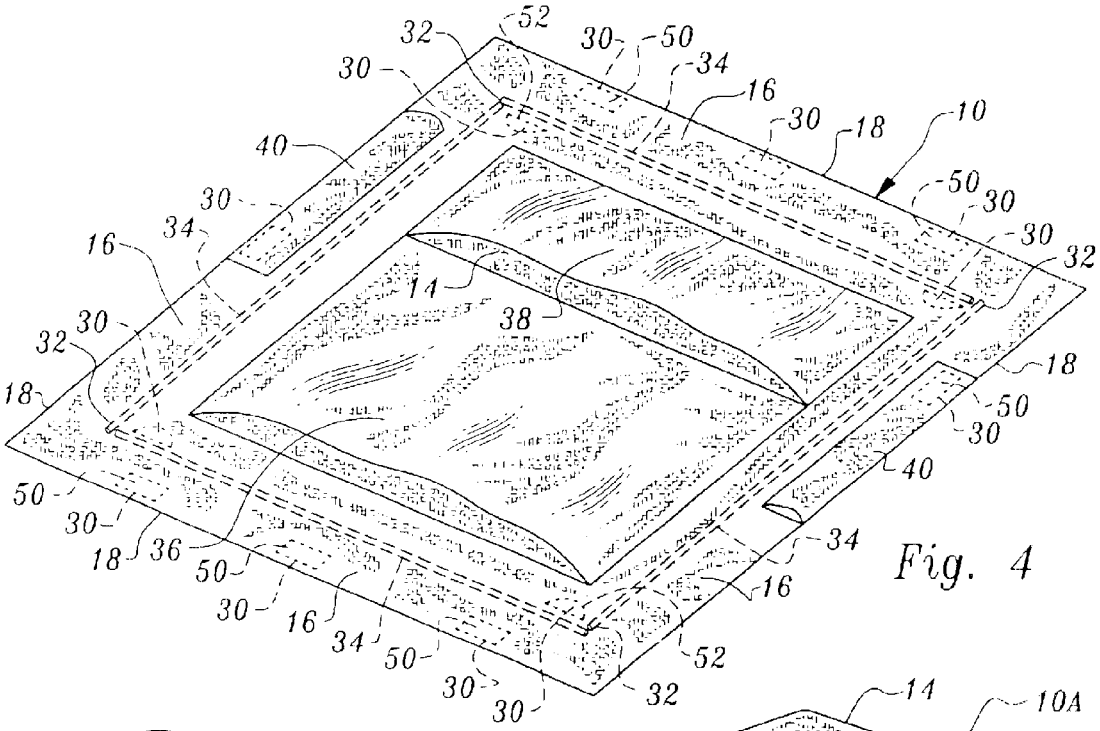
FIG. 4 is a perspective view of the bottom of the canopy of the apparatus removed from the canopy support, the canopy spread flat.

Referring now to FIGS. 1–5, collapsible, self-supporting, portable sun-screen apparatus constructed in accordance with the teachings of the present invention includes a flexible canopy 10 and a canopy support 12. The canopy 10 may be formed of any suitable flexible material, such as cloth, plastic mesh or sheeting, etc.

The canopy 10 includes a central canopy segment 14 having an outer periphery. In this instance, the flexible canopy in its entirety and also the central canopy segment have a rectangular configuration. Attached to the central canopy segment (and in the preferred embodiment disclosed, integral with the central canopy segment), are four side canopy segments 16, also integral with one another. The side canopy segments depend from the outer periphery of the central canopy segment and have side canopy segment lower edges 18.

Canopy support 12 supports canopy 10 as shown in FIGS. 1 and 3. The canopy support includes a canopy support base 20 for positioning on the ground or other support surface. The canopy support further includes two vertically disposed elongated elements or posts 22 connected to the back or rear of the canopy support base and extending upwardly therefrom.

A canopy support frame 24 is connected to the elongated elements 22 at a location spaced from the canopy support base. The canopy support frame 24 extends over the canopy support base.

In the arrangement illustrated, the canopy support is formed from selectively disconnectable canopy support portions in the nature of elongated tubular members releasably interconnected by fittings. In the disclosed embodiment, the fittings are tees 26 and elbows 28. The tubular members may suitably be PVC tubes of the type employed for irrigation purposes and the fittings may be conventional PVC fittings employed for that purpose also. However, it is to be understood that the principles of the present invention encompass the use of other types of suitable materials such as other types of plastic, lengths of bamboo, etc.

The illustrated canopy support base 20 has a U-shaped configuration, being open at the front. The base is of sufficient size to enable a conventional chair C (FIG. 1) to be positioned under-the canopy. Since the apparatus is completely self-supporting, there need be no interconnection whatsoever between the apparatus and the chair.

The frame 24 is of rectangular configuration and is cantilevered from the vertically disposed elongated elements 22 to project forwardly of the vertically disposed elongated elements. The tubular portions of the canopy support frame are merely friction fit into the tees and elbows since the apparatus is designed for disassembly and collapse after use.

After the canopy support has been assembled as shown in FIG. 2, the canopy 10 is positioned over frame 24. The side canopy segments 16 are disposed outside of the frame and alongside the frame. The canopy is not attached to the frame or any other portion of the canopy support. This allows the central canopy segment to be slid on the frame by exerting a manual force thereon. This, as shown for example in FIG. 3, allows the canopy to be offset relative to the frame and the distances between the side canopy segment lower edges and the ground to be changed. Typically, this process would take place when the sun changes location in the sky to a position which results in sunlight impacting the occupant of the chair C unless the canopy is shifted from its initial position.

In FIG. 3, for example, the canopy has been shifted forward so that the bottom edge of the front side canopy segment 16 is lowermost. Of course, the canopy could be offset toward the back if desired or laterally to either of the sides if that is desirable to provide effective shading.

To provide stability to the canopy, weights (FIG. 4) are provided at various locations of the canopy. These weights are suitably disposed in pockets 50, 52 formed by the material of the canopy having the configurations of the weights carried thereby.

Another feature for providing stabilization to the canopy and to assist in maintaining it in location after adjustment has been made are stabilizer rods or bars 32 positioned in sleeves 34 sewn in the canopy. The sleeves surround the central canopy segment. The relatively rigid stabilizer bars not only maintain a degree of stiffness, they also add further weight to increase the degree of frictional engagement between the canopy and the frame, resisting canopy movement.

In the arrangement illustrated, the inside of the canopy has receptacles 36, 38 and 40 which may be utilized to store objects, which also weigh down the canopy.

Figure 5:
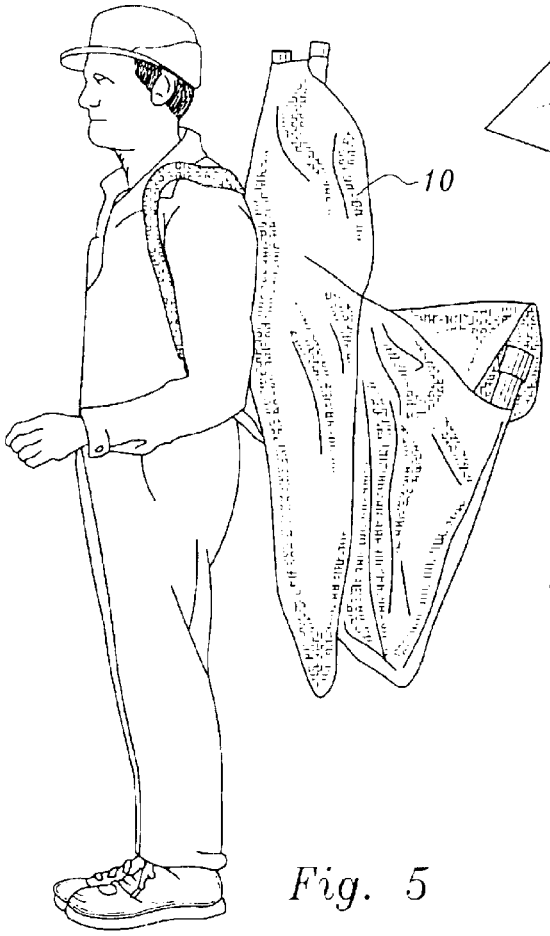
FIG. 5 is a perspective view of an individual carrying the apparatus in collapsed condition.

As indicated above, the apparatus may readily be disassembled after use. FIG. 5 shows the canopy 10 collapsed and holding disassembled portions of the canopy support. FIG. 5 shows the use of shoulder straps to facilitate carrying of the collapsed and disassembled apparatus. If desired, these shoulder straps may be permanently attached to the canopy.

Figure 6:
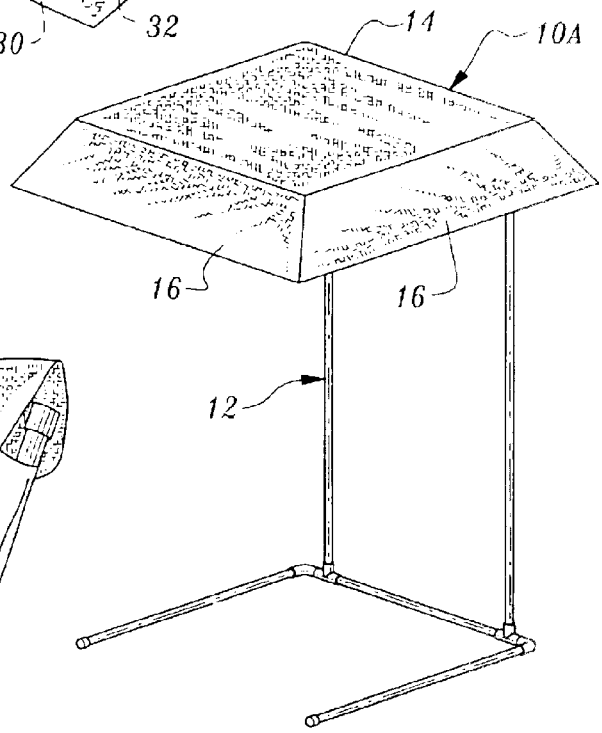
FIG. 6 is a view similar to FIG. 1, but illustrating an alternative embodiment of the invention.

FIG. 6 illustrates an alternative embodiment of canopy, canopy 10A. In this embodiment, the stabilizer bars (not shown) are located at the very bottom edges of side canopy segments 16, rather than spaced therefrom.

The invention claimed is:

1. Collapsible, self-supporting, portable sun-screen apparatus comprising, in combination:

a flexible canopy having a central canopy segment having an outer periphery and a side canopy segments depending from the outer periphery of said central canopy segment, said side canopy segments having side canopy segment lower edges;

a canopy support supporting said canopy, said canopy support including a canopy support base for positioning on the ground or other support surface, at least one vertically disposed elongated element connected to said canopy support base and extending upwardly therefrom and a canopy support frame connected to said at least one vertically disposed elongated element at a location spaced from said canopy support base and extending over said canopy support base, said central canopy segment being positioned on said frame with the side canopy segments disposed outside of said frame and alongside said frame, said canopy not being attached to said frame whereby the central canopy segment may be slid on said frame by exerting a manual force to offset the canopy relative to the frame and change the distances between the side canopy segment lower edges and the ground or other support surface, said canopy including sleeves surrounding said central canopy segment; and relatively rigid stabilizer bars positioned in said sleeves.

2. The apparatus according to claim 1 additionally comprising weights connected to said canopy for exerting forces on said canopy to stabilize said canopy and resist movement of said canopy relative to said frame whereby the canopy will be maintained at a selected position relative to said frame after the manual force is removed therefrom.

3. The apparatus according to claim 2 wherein at least some of said side canopy segments are weighted by weights connected thereto.

4. The apparatus according to claim 3 wherein at least some of said side canopy segments include a receptacle for holding a weight.

5. The apparatus according to claim 1 wherein said central canopy segment is four sided and has a rectangular configuration and wherein a stabilizer bar extends along each of the four sides of the central canopy segment, said side canopy segments extending downwardly from the four sides of the central canopy segment.

6. The apparatus according to claim 1 wherein said frame has a rectangular-shaped outer periphery.

7. The apparatus according to claim 1 wherein said canopy support is comprised of a plurality of selectively disconnectable canopy support portions.

8. The apparatus according to claim 7 wherein said canopy support portions include elongated tubular members releasably interconnected by fittings.

9. The apparatus according to claim 1 wherein said canopy support base defines an opening for receiving a chair.

10. The apparatus according to claim 9 wherein said canopy support base has a U-shaped configuration, a front and a back, said front being open, said at least one vertically disposed elongated element projecting upwardly from said back, said frame being cantilevered from said at least one vertically disposed elongated element and projecting forwardly of said at least one vertically disposed elongated element.

11. The apparatus according to claim 1 additionally including receptacles connected to said canopy.

* * * * *